US011440045B2

(12) United States Patent
Waldo et al.

(10) Patent No.: US 11,440,045 B2
(45) Date of Patent: Sep. 13, 2022

(54) METHOD OF PROVIDING A PERSONALIZED SKIN CARE COMPOSITION WHERE THE COMPOSITION IS MIXED WITH A MIXING ELEMENT THAT DOES NOT CONTACT THE INGREDIENTS DURING MIXING

(71) Applicant: The Procter & Gamble Company, Cincinnati, OH (US)

(72) Inventors: Kristin Toop Waldo, Washington Township, OH (US); Thomas Elliot Rabe, Baltimore, MD (US); Rhea Jacqueline Patten, Edinburgh (GB)

(73) Assignee: The Procter & Gamble Company, Cincinnati, OH (US)

( * ) Notice: Subject to any disclaimer, the term of this patent is extended or adjusted under 35 U.S.C. 154(b) by 384 days.

(21) Appl. No.: 16/733,290

(22) Filed: Jan. 3, 2020

(65) Prior Publication Data

US 2020/0215568 A1 Jul. 9, 2020

Related U.S. Application Data

(60) Provisional application No. 62/788,103, filed on Jan. 3, 2019.

(51) Int. Cl.
*B05C 17/005* (2006.01)
*A45D 34/04* (2006.01)
(Continued)

(52) U.S. Cl.
CPC ..... *B05C 17/00556* (2013.01); *A45D 34/04* (2013.01); *B01F 31/311* (2022.01);
(Continued)

(58) Field of Classification Search
CPC ..... B05C 17/00556; B05C 17/00583; A45D 34/04; A45D 2034/005; A45D 2200/058;
(Continued)

(56) References Cited

U.S. PATENT DOCUMENTS 3,819,158 A * 6/1974 Sharpe ..... B01F 31/55 366/349
4,049,242 A * 9/1977 Porter ..... B01F 31/55 366/292
(Continued)

FOREIGN PATENT DOCUMENTS

CA 2524450 A1 11/2004
CN 204684992 U 10/2015
(Continued)

OTHER PUBLICATIONS

15450 PCT Search Report and Written Opinion for PCT/US2019/067041 dated Apr. 1, 2020.
(Continued)

*Primary Examiner* — Charles Cooley
(74) *Attorney, Agent, or Firm* — Alexandra S. Anoff

(57) ABSTRACT

A personalized skin care system that includes a dispensing device, at least one removable cartridge, a single-dose pod, and a mixing element. The removable cartridge contains a sufficient amount of skin care active to make several doses of a personalized skin care composition. The single-use pod contains a sufficient amount of base ingredient to make a single dose of personalized care composition. To provide a personalized skin care composition, one or more personalization factors are inputted into the system. The hermetically-sealed, single-use pod is placed in the dispensing device such that it is in fluid communication with the replaceable cartridge containing the skin care active. The skin care active(s) is transported to the single-dose pod and mixed with the mixing element. However, the mixing ele-
(Continued)

ment does not come into contact with the ingredients inside the single-use pod. The resulting personalized skin care composition can then be dispensed to a user.

18 Claims, 12 Drawing Sheets

(51) Int. Cl.
*B65D 35/28* (2006.01)
*B01F 31/31* (2022.01)
*A45D 34/00* (2006.01)

(52) U.S. Cl.
CPC ..... *B05C 17/00583* (2013.01); *B65D 35/285* (2013.01); *A45D 2034/005* (2013.01)

(58) Field of Classification Search
CPC ..... A45D 34/00; A45D 40/24; B65D 35/285; B01F 31/55; B01F 31/31; B01F 31/311; B01F 31/312
See application file for complete search history.

(56) References Cited

U.S. PATENT DOCUMENTS 4,550,654 A * 11/1985 Hedenberg ..... A21B 7/005 99/348
4,590,850 A * 5/1986 Hedenberg ..... A47J 43/04 99/348
4,871,262 A 10/1989 Krauss et al.
5,146,840 A * 9/1992 Hedenberg ..... B65D 81/3266 99/341
5,163,010 A 11/1992 Klein et al.
5,622,692 A 4/1997 Rigg et al.
5,785,960 A 7/1998 Rigg et al.
5,903,465 A 5/1999 Brown
6,142,661 A * 11/2000 Lafond ..... B01F 31/55 366/347
6,267,498 B1 * 7/2001 Lafond ..... B01F 31/55 366/349
6,273,600 B1 * 8/2001 Sharpe ..... B01F 31/55 366/117
6,386,850 B1 * 5/2002 Salerno ..... B29C 44/16 425/436 R
6,439,759 B1 * 8/2002 Ray ..... B01F 31/55 366/197
6,454,135 B1 9/2002 Brozell
6,510,366 B1 1/2003 Murray et al.
6,516,245 B1 2/2003 Dirksing et al.
6,540,486 B2 4/2003 Amsler et al.
6,598,627 B2 7/2003 Manzari et al.
6,622,064 B2 9/2003 Bartholomew et al.
6,672,341 B2 1/2004 Bartholomew et al.
6,715,642 B2 4/2004 Engel et al.
6,845,706 B2 * 1/2005 Kim ..... A21C 1/00 99/348
6,856,861 B2 2/2005 Dirksing
6,883,561 B2 4/2005 Bartholomew et al.
6,986,442 B2 1/2006 Engel
7,077,559 B2 * 7/2006 Hlavinka ..... A61L 2/0088 422/44
7,082,970 B2 8/2006 Bartholomew et al.
7,097,348 B2 8/2006 Miller
7,099,740 B2 8/2006 Bartholomew et al.
7,111,652 B2 9/2006 Koide et al.
7,121,429 B2 10/2006 Bartholomew et al.
7,174,310 B2 2/2007 Bartholomew et al.
7,395,134 B2 7/2008 Bartholomew et al.
7,475,710 B2 1/2009 Bartholomew et al.
7,562,680 B2 7/2009 Khoo et al.
7,624,769 B2 12/2009 Bartholomew et al.
7,690,405 B2 4/2010 Miller et al.
7,822,504 B2 10/2010 Bartholomew et al.
8,141,596 B2 3/2012 Bartholomew et al.
8,352,070 B2 1/2013 Bartholomew et al.
8,511,047 B2 * 8/2013 Mahon ..... B29B 7/7689 53/553
8,564,776 B2 10/2013 Igarashi
8,608,371 B2 12/2013 Bartholomew et al.
8,640,432 B2 2/2014 Rodrigues
8,830,468 B2 9/2014 Igarashi
8,858,484 B2 10/2014 Casey et al.
8,880,218 B2 11/2014 Bartholomew et al.
8,977,389 B2 3/2015 Witchell et al.
9,022,679 B2 5/2015 Samangooie
9,122,919 B2 9/2015 Howell et al.
9,566,421 B2 2/2017 Casey et al.
9,808,071 B2 11/2017 Thiebaut et al.
9,918,931 B2 3/2018 Dersh et al.
9,961,984 B2 5/2018 Witchell et al.
10,004,316 B2 6/2018 Streeter
10,022,741 B2 * 7/2018 Fuller ..... B05B 11/3084
10,025,280 B1 7/2018 Bly
10,046,301 B2 8/2018 Quinn et al.
10,207,234 B2 * 2/2019 Ray ..... B01F 23/43
10,946,563 B2 * 3/2021 Vilag ..... B01F 31/55
10,967,342 B2 * 4/2021 Tourel ..... B01F 23/41
11,325,286 B2 * 5/2022 Gray ..... B31D 5/0078
2002/0092278 A1 * 7/2002 Sperry ..... B31D 5/0078 53/553
2002/0131985 A1 9/2002 Shana et al.
2003/0031085 A1 * 2/2003 Baron ..... B01F 31/55 366/144
2003/0196557 A1 * 10/2003 Kim ..... A21C 1/00 99/348
2008/0186802 A1 * 8/2008 Bungay ..... C12M 27/02 366/144
2008/0206165 A1 8/2008 Mitra et al.
2009/0038270 A1 * 2/2009 Mahon ..... B31D 5/0078 53/469
2012/0261028 A1 * 10/2012 Gray ..... B29C 44/3442 141/69
2014/0230377 A1 8/2014 Cartner et al.
2014/0277704 A1 9/2014 Memar
2014/0311625 A1 10/2014 Bartholomew et al.
2015/0231582 A1 8/2015 Schwartz
2015/0291411 A1 10/2015 Ittstein
2016/0221727 A1 8/2016 Stanley et al.
2016/0286938 A1 * 10/2016 Ebeling ..... G06Q 10/083
2016/0288069 A1 10/2016 Jasperson et al.
2017/0001782 A1 1/2017 Arent et al.
2017/0151538 A1 6/2017 Balooch et al.
2017/0154372 A1 6/2017 Balooch et al.
2017/0304789 A1 * 10/2017 Tourel ..... B01F 23/711
2017/0367462 A1 12/2017 Samain et al.
2017/0368511 A1 12/2017 Gunia et al.
2018/0033161 A1 2/2018 Nichol et al.
2018/0072480 A1 3/2018 Genosar
2018/0280277 A1 10/2018 Lu et al.
2018/0280905 A1 10/2018 Orsita et al.
2018/0284729 A1 10/2018 Orsita et al.
2018/0285952 A1 10/2018 Lu et al.
2018/0326626 A1 * 11/2018 Gray ..... B29C 44/182
2018/0333694 A1 11/2018 Quinn et al.
2018/0368558 A1 12/2018 Park
2019/0001289 A1 1/2019 Leloup
2019/0022610 A1 1/2019 Leloup
2019/0188809 A1 6/2019 Jung et al.
2019/0200733 A1 7/2019 Thiebaut et al.
2020/0215568 A1 * 7/2020 Waldo ..... A45D 34/00
2020/0330938 A1 * 10/2020 Singh ..... B01F 31/55
2022/0212153 A1 * 7/2022 Oh ..... B01F 33/841

FOREIGN PATENT DOCUMENTS

CN 206474099 U 9/2017
CN 107767234 A 3/2018
CN 108211909 A 6/2018
CN 108380121 A 8/2018
CN 108380124 A 8/2018
CN 207680464 U 8/2018

(56) References Cited

FOREIGN PATENT DOCUMENTS

| | | | | | |
|---|---|---|---|---|---|
| CN | 208260627 | U | | 12/2018 | |
| CN | 109847618 | A | | 6/2019 | |
| CN | 110012662 | A | | 7/2019 | |
| DE | 4110299 | C1 | | 2/1993 | |
| EP | 0443741 | A1 | | 8/1991 | |
| EP | 1297409 | A1 | | 4/2003 | |
| EP | 1177036 | B1 | | 7/2003 | |
| EP | 1919343 | A1 | | 5/2008 | |
| EP | 1910095 | B1 | | 10/2016 | |
| EP | 2922622 | B1 | | 2/2017 | |
| EP | 3478399 | A2 | | 5/2019 | |
| FR | 3041133 | A1 | | 3/2017 | |
| GB | 2506432 | A | * | 4/2014 | ..... B01F 11/00 |
| JP | 2016023172 | A | | 2/2016 | |
| KR | 101490987 | B1 | | 2/2015 | |
| KR | 101520386 | B1 | | 5/2015 | |
| KR | 20170140648 | A | | 12/2017 | |
| KR | 20180007500 | A | | 1/2018 | |
| KR | 20180110257 | A | | 10/2018 | |
| KR | 101913729 | B1 | | 11/2018 | |
| KR | 101951235 | B1 | | 2/2019 | |
| WO | 9505892 | A1 | | 3/1995 | |
| WO | 02069215 | A1 | | 9/2002 | |
| WO | 2010092413 | A2 | | 8/2010 | |
| WO | 2014037967 | A1 | | 3/2014 | |
| WO | 2014066721 | A2 | | 5/2014 | |
| WO | 2014080093 | A1 | | 5/2014 | |
| WO | 2016014564 | A1 | | 1/2016 | |
| WO | 2016087470 | A3 | | 8/2016 | |
| WO | 2017118799 | A1 | | 7/2017 | |
| WO | 2017118800 | A1 | | 7/2017 | |
| WO | 2017118801 | A1 | | 7/2017 | |
| WO | 2017118802 | A1 | | 7/2017 | |
| WO | 2017118803 | A1 | | 7/2017 | |
| WO | 2017182530 | A1 | | 10/2017 | |
| WO | 2018044010 | A1 | | 3/2018 | |
| WO | 2018062970 | A1 | | 4/2018 | |
| WO | 2018062975 | A1 | | 4/2018 | |
| WO | 2018064737 | A1 | | 4/2018 | |
| WO | 2018101572 | A1 | | 6/2018 | |
| WO | 2018174693 | A2 | | 9/2018 | |
| WO | 2018174694 | A1 | | 9/2018 | |
| WO | 2018187151 | A1 | | 10/2018 | |
| WO | 2018/215743 | A1 | * | 11/2018 | |
| WO | 2018234657 | A1 | | 12/2018 | |
| WO | 2019031868 | A1 | | 2/2019 | |
| WO | 2019052838 | A3 | | 5/2019 | |

OTHER PUBLICATIONS

Lesielle , The World's first Adaptive Skin Care, Retrieved on dated Oct. 15, 2018, 37 Pages.

Nuskin, The Modern Skin Care Regimen: Customized through ageLOC Me Retrieved from https://www.nuskin.com/content/corpcom/en_US/thesource/skincare/the-modern-skin-care-regimen--customized-through-ageloc-me.html, Published on Mar. 9, 2017, 7 Pages.

Romy Paris, A Next-Generation Beauty Concept, Published on Sep. 23, 2015, 5 Pages.

Romy, Figure user manual, Retrieved on Oct. 15, 2018, 17 Pages.

Romy, HyLab Personal Skincare Lab, https://www.romy.paris/uk/hylab-personal-skincare-lab/ Retrieved on Oct. 15, 2018, 6 Pages.

Shiseido Group Optune, Published on Nov. 27, 2017, 4 Pages.

* cited by examiner

METHOD OF PROVIDING A PERSONALIZED SKIN CARE COMPOSITION WHERE THE COMPOSITION IS MIXED WITH A MIXING ELEMENT THAT DOES NOT CONTACT THE INGREDIENTS DURING MIXING

FIELD

The present disclosure relates generally to a skin care system that provides personalized skin care compositions in an in-home setting. More specifically, the present disclosure relates to an in-home, aseptic skin care system that can provide a personalized skin care composition based on personal and environmental factors.

BACKGROUND

The desire for younger looking skin in today's youth conscience society fuels a multi-billion-dollar global skin care industry. In the past, it was sufficient for skin care brands to offer a relatively small number of mass-produced skin care products that were intended to broadly treat a general class of skin conditions or skin types (e.g., oily, hyperpigmented, or wrinkled skin). However, some consumers may experience more than one type of skin condition or have a skin condition that falls outside the general classes used by skin care industry. In addition, the undesirable skin conditions experienced by some consumers may vary from day to day based on, environmental changes, hormonal changes, lifestyle changes, etc. For these consumers, a single skin care product may not satisfactorily address all their skin care needs, and they may resort to buying multiple products to treat the various undesirable skin conditions they experience. However, purchasing multiple skin care products and/or determining which skin product is needed can be undesirable for a variety of reasons. For example, skin care products can be relatively expensive, which presents a financial obstacle to the consumer. Additionally, trying to select a suitable skin care composition from the multitude of skin care compositions currently available in the marketplace can be daunting. Thus, providing a personalized skin care composition fills a significant consumer need in the cosmetic skin care industry.

The in-home skin care category is currently dominated by individual products with a minimum degree of customization available through different products for different skin types. However, consumers nowadays expect their skin care regime to enable them to tailor their skin care products to match not only their usual skin type but to be flexible enough to respond to their changing skin condition, environment, lifestyle and activities for maximum effectiveness. Increasing the number of skin care products offered to consumers may provide some additional flexibility for tailoring a skin care regimen, it also creates challenges related to increased formulation complexity and shelf space limitations.

Various attempts have been made to provide consumers with personalized skin care compositions at the point of purchase. For example, U.S. Pat. No. 5,903,465 to Brown describes a dispensing machine that provides a custom blend of ingredients for delivering a personalized composition. However, the device described by Brown, et al., only provides a personalized skin care composition in a retail environment. For a consumer whose skin care needs change frequently, constantly going to the store for a personalized skin care product may be inconvenient.

More recently, attempts have been made to providing in-home systems and devices for providing a personalized skin care composition. For example, U.S. Pat. No. 10,022,741 to Fuller, et. al., discloses an actuated system for precision fluid dispensing applications in a hygienic environment, including personalized skin care applications. To provide a personalized skin care composition, the system described by Fuller, et. al., either mixes ingredients together in a manifold prior to dispensing or dispenses different fully mixed compositions (e.g., day and night compositions) from separate dispensing nozzles. On the one hand, the manifold must either be cleaned or replaced to avoid contamination of a subsequently dispensed composition, which may be undesirable for a variety of reasons (e.g., increased manufacturing cost and complexity, user unfriendliness, and environmental unfriendliness). On the other hand, dispensing a fully mixed composition limits the ability of a user to select skin care actives tailored to target their particular skin condition.

Thus, there remains a need for an in-home system that provides personalized skin care compositions tailored to meet the frequently changing skin care needs of a user. There also remains a need for an in-home system that provides personalized skin care composition in a more cost effective, user friendly way.

SUMMARY

Described herein is a personalized skin care system, comprising: a dispensing device that includes at least one wall defining an interior space; a removable cartridge disposed in the interior space, the removable cartridge containing a skin care active; a single-use pod disposed in the dispensing device, wherein the single-use pod is in fluid communication with the removable cartridge and contains a base ingredient; and a mixing element, wherein the mixing element is configured to mix the active ingredient and the base ingredient together inside the single-use pod without contacting either ingredient.

Also described is a method of providing a personalized skin care composition, comprising: inputting a personalization factor into a personalized skin care system, wherein the personalized skin care system comprises: a dispensing device that includes at least one wall defining an interior space, and a removable cartridge disposed in the interior space, the removable cartridge containing a skin care active, and a mixing element; placing a hermetically-sealed, single-dose pod containing a base ingredient in the interior space of the dispensing device such that the single-use pod is in fluid communication with the replaceable cartridge; selecting a personalized skin care composition based on the inputted personalization factor; transferring the skin care active to the single-use pod; mixing the skin care active and the base ingredient with a mixing element to form a personalized skin care composition; and dispensing the personalized skin care composition.

DETAILED DESCRIPTION

Figure 1A:
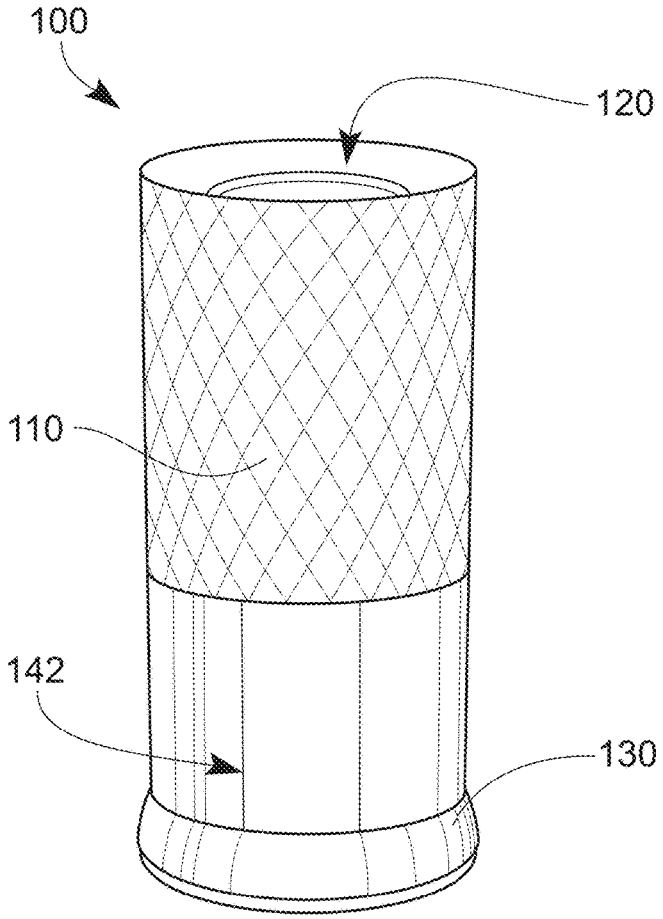
FIGS. 1A and 1B show an embodiment of a dispensing device for use in the present system.

The present skin care system includes a portable dispensing device for providing a personalized skin care composition to a consumer in an in-home environment. The system overcomes some of the drawbacks of prior systems by providing a well-mixed, single-dose skin care composition without requiring contact between the composition with the mixing elements of the dispensing device, thus avoiding any contamination of the dispensing device components and the composition. While the personalized compositions herein are generally described as topical skin care compositions, it is to be appreciated that the present system can be readily adapted for other uses (e.g., hair care compositions and medical/prescription skin care compositions), which is within the skill of the ordinary artisan. Reference within the specification to "embodiment(s)" or the like means that a particular material, feature, structure and/or characteristic described in connection with the embodiment is included in at least one embodiment, optionally a number of embodiments, but it does not mean that all embodiments incorporate the material, feature, structure, and/or characteristic described. Furthermore, materials, features, structures and/or characteristics may be combined in any suitable manner across different embodiments, and materials, features, structures and/or characteristics may be omitted or substituted from what is described. Thus, embodiments and aspects described herein may comprise or be combinable with elements or components of other embodiments and/or aspects despite not being expressly exemplified in combination, unless otherwise stated or an incompatibility is stated.

All ingredient percentages are by weight of the cosmetic composition, unless specifically stated otherwise. All ingredient ratios are weight ratios, unless specifically stated otherwise. All ranges are inclusive and combinable. The number of significant digits conveys neither a limitation on the indicated amounts nor on the accuracy of the measurements. Unless otherwise indicated, all measurements are understood to be made at approximately 25° C. and at ambient conditions, where "ambient conditions" means conditions under about 1 atmosphere of pressure and at about 50% relative humidity. All numeric ranges are inclusive of narrower ranges; delineated upper and lower range limits are interchangeable to create further ranges not explicitly delineated.

The compositions of the present invention can comprise, consist essentially of, or consist of, the essential components as well as optional ingredients described herein. As used herein, "consisting essentially of" means that the composition or component may include additional ingredients, but only if the additional ingredients do not materially alter the basic and novel characteristics of the claimed compositions or methods. As used in the description and the appended claims, the singular forms "a," "an," and "the" are intended to include the plural forms as well, unless the context clearly indicates otherwise.

Definitions

"About" when used in the context of a parameter or range means a value that is within 30% of the stated value (e.g., with 25%, 20%, 15%, 10%, 5%, 2% or even within 1%).

"Base ingredient" means any ingredient in a skin care composition that is not a skin care active. Some non-limiting examples of base ingredients are carriers, preservatives, thickeners, emulsifiers, opacifiers, colorants, pH adjusters, coloring agents, perfumes, film-forming agents, chelators, and lubricants.

"Derivative" refers to a molecule that is similar to another molecule but differs with respect to a certain functional moiety. Derivatives may be formed by known reactive pathways. Suitable functional moieties include esters, ethers, amides, amines, carboxylic acids, hydroxyls, halogens, thiols, and/or salt derivatives of the relevant molecule. Peptide derivatives include peptides joined to another moiety such as a fatty acid chain.

"Dermatologically acceptable" means that an ingredient or composition (e.g., carrier) is suitable for topical application to the keratinous tissue, has good aesthetic properties, is compatible with the actives in the composition, and will not cause any unreasonable safety or toxicity concerns.

"Disposed" refers to an element being located in a particular place or position relative to another element.

"Joined" means configurations whereby an element is directly secured to another element by affixing the element directly to the other element, and configurations whereby an element is indirectly secured to another element by affixing the element to intermediate member(s) that in turn are affixed to the other element.

"Regulating a skin condition" means improving skin health, appearance, and/or feel, for example, by providing a benefit, such as a smoother appearance and/or feel. Herein, "improving skin condition" means effecting a visually and/or tactilely perceptible positive change in skin appearance and feel. The benefit may be a chronic or acute benefit and may include one or more of the following: reducing the appearance of wrinkles and coarse deep lines, fine lines, crevices, bumps, and large pores; thickening of keratinous tissue (e.g., building the epidermis and/or dermis and/or sub-dermal layers of the skin, and where applicable the keratinous layers of the nail and hair shaft, to reduce skin, hair, or nail atrophy); increasing the convolution of the dermal-epidermal border (also known as the rete ridges); preventing loss of skin or hair elasticity, for example, due to loss, damage and/or inactivation of functional skin elastin, resulting in such conditions as elastosis, sagging, loss of skin or hair recoil from deformation; reduction in cellulite; change in coloration to the skin, hair, or nails, for example, under-eye circles, blotchiness (e.g., uneven red coloration due to, for example, rosacea), sallowness, discoloration caused by hyperpigmentation, etc.

"Safe and effective amount" means an amount of a compound or composition sufficient to significantly induce a desired skin benefit, including, independently or in combination, the benefits disclosed herein, but low enough to avoid serious side effects (i.e., to provide a reasonable benefit to risk ratio, within the scope of sound judgment of the skilled artisan).

"Skin" means the outermost protective covering of mammals that is composed of cells such as keratinocytes, fibroblasts and melanocytes. Skin includes an outer epidermal layer and an underlying dermal layer. Skin may also include hair and nails as well as other types of cells commonly associated with skin, such as, for example, myocytes, Merkel cells, Langerhans cells, macrophages, stem cells, sebocytes, nerve cells and adipocytes.

"Skin care" means regulating and/or improving a skin condition. Some nonlimiting examples include improving skin appearance and/or feel by providing a smoother, more even appearance and/or feel; increasing the thickness of one or more layers of the skin; improving the elasticity or resiliency of the skin; improving the firmness of the skin; and reducing the oily, shiny, and/or dull appearance of skin, improving the hydration status or moisturization of the skin, improving the appearance of fine lines and/or wrinkles, improving skin exfoliation or desquamation, plumping the skin, improving skin barrier properties, improve skin tone, reducing the appearance of redness or skin blotches, and/or improving the brightness, radiancy, or translucency of skin.

"Skin care active" means a compound or combination of compounds that, when applied to skin, provide an acute and/or chronic benefit to skin or a type of cell commonly found therein. Skin care actives may regulate and/or improve skin or its associated cells (e.g., improve skin elasticity; improve skin hydration; improve skin condition; and improve cell metabolism).

"Skin care composition" means a composition that includes a skin care active and regulates a skin condition.

Personalized Skin Care System

The personalized skin care system herein includes a dispensing device, one or more replaceable skin care active cartridges, and a hermetically-sealed, single-use pod containing one or more base ingredients. The single-use pod may be disposable or refillable. The skin care active cartridges are in fluid communication with the single-use pod to form a closed, aseptic system. In some instances, the skin active can be transferred through one or more tubes or the like to the single-use pod using a suitable pump (e.g., a screw-driven piston pump or a peristaltic pump). Upon transfer to the single-use pod, the skin care active(s) and the base ingredient(s) are mixed together in situ. The resulting personalized skin care composition may then be dispensed to a user. The single-use pod may be sized to deliver a single dose of skin care composition or multiple doses. For example, a user may select a single dose of skin care composition when the system is used at home. However, a user may also select multiple doses of skin care composition, which can be dispensed into a portable container by the system for away-from-home use. The number and/or size of the doses dispensed by the system may be varied by providing different sizes of single-use pods and/or by varying the concentration of skin care active in the personalized skin care composition. In some instances, the single-use pod may have a volume of 5 to 50 milliliters (ml) (e.g., 10 to 30 ml or 15 to 25 ml).

The present system includes one or more cartridges, each containing one or more skin care actives. When two or more cartridges are present (e.g., between 2 and 10) The skin care active(s) contained in each cartridge may be the same as or different from the skin care active(s) contained in another cartridge. In some instances, 2 or more cartridges may contain the same skin care active, but at different concentrations. The size and shape of the cartridges are not particularly limited. However, it may be desirable to configure the cartridges to minimize the amount of space required to store the cartridges inside the dispensing device. The cartridges may be made of any suitable material known in the art for use with cosmetic skin care products (e.g., non-toxic, non-reactive, fluid impermeable, and bio-based). In some instances, the cartridges contain enough skin care active to formulate more than one dose of a personalized skin care composition. For example, the cartridges may contain enough skin care to formulate between 2 and 100 doses of a personalized skin care composition (e.g., between 5 and 60, 10 and 45, or even between 15 and 30 doses). In some instances, it may be desirable to include one or more base ingredients in the cartridge with the skin care active. For example, it may be desirable to dilute an active that is known to cause sensitivity issues or is generally used in low concentrations (e.g., retinoids). In some instances, the cartridges may have a total volume of 5 to 50 milliliters (mL).

In some instances, the cartridges and/or single-use pods may be configured to provide information to the system related to the ingredient contained in the cartridge and/or single-use pod. For example, the cartridge and/or single-use pod may include an identifier such as a bar code, Quick Response (QR) code, radio-frequency identification (RFID) chip, combinations of these, and the like, which can be detected by the dispensing device. The information provided to the system may be used to facilitate formulation of the personalized skin care composition without additional effort from the user. Additionally or alternatively, the identifier on the cartridge and/or single-use pod may be detected using the camera on a smart phone or similar device, which then communicates the identifier information to the system or dispensing device via a suitable software application.

The present system may be configured to select the type and amount of active ingredient(s) and/or base ingredient(s) used to make the personalized skin care composition based on one or more user personalization factors manually or automatically provided to the system. For example, one or more personalization factors may be automatically provided to the system by a skin diagnostic tool in electronic communication with the system. Additionally or alternatively, one or more personalization factors may be manually provided to the system by a user or a skin care professional, for example, via an interface on the dispensing device or a mobile or web-based app accessed with a smart phone. Non-limiting examples of user personalization factors can include age, ethnicity, skin type, lifestyle, apparent skin age, geographic location, environmental factors (weather, season, time of day, etc.), results from a skin analysis or diagnosis, and history of skin care product usage. Additionally or alternatively, the type and/or amount of active ingredient(s) and/or base ingredient(s) may be manually selected by a user.

The system may include one or more computers in electronic communication with the dispensing device and, optionally, each other, for example, via a network (e.g., a wide area network such as a mobile telephone network, a public switched telephone network, a satellite network, and/or the internet; a local area network such as wireless-fidelity, Wi-Max, ZigBee™, and/or Bluetooth™; and/or other suitable forms of networking capabilities). In some instances, the dispensing device includes a controller (e.g., solid-state microcontroller) that controls one or more components of the dispensing device, for example, by accessing logic stored on a non-transitory memory component (e.g., random access memory, read only memory, registers, and the like). In some instances, the controller causes the dispensing device to send and/or receive information to a remote computer over a network via a wired or wireless connection. The remote computer may be a server (or plurality of servers), personal computer, mobile computer, smart phone, and/or other suitable computing device. In some instances, the system may be configured to wirelessly communicate with a software-based, skin diagnostic tool (e.g., a native or web-based software application) stored on a remote computing device (e.g., a server, a personal computer, or a smart phone). In some instances, the system may be configured to communicate with a database of user personalization factors stored on a remote computing device. In this way, information from the diagnostic tool and/or database can be used by the system to determine a user's personalization factors.

The dispensing device may include an interface that enables a user to provide information to and/or receive information from the present system. For example, the interface may indicate the type of skin care composition selected and/or enable to a user to select a particular skin care composition. In some instances, the interface may enable a user to access and/or modify their personalization factors. The interface may include a display (e.g., a liquid crystal display ("LCD") for communicating information to a user. In some instances, the dispensing device may include a plurality of lights (e.g., light emitting diodes) that turn on or off, individually or cooperatively (e.g., in a sequence), to non-verbally communicate information to a user and/or to provide a desirable aesthetic effect. In some instances, a smart phone may be used as an interface with the dispensing device, for example, by pairing the smart phone with the dispensing device using conventional methods of wirelessly pairing electronic devices.

In one example, a user may use a smartphone or other internet-of-things (IOT) device to identify skin features (e.g., wrinkles, spots, dryness) and/or environmental data, which are provided to an artificial intelligence (AI) skin diagnostic tool. In this example, the AI skin diagnostic tool would communicate with the dispensing device and/or the user to provide a recommended skin care product and/or skin care regimen based on an analysis of the skin features and/or environmental data. The user could then decide whether to accept the recommended product and/or regimen or choose another.

Figure 1B:
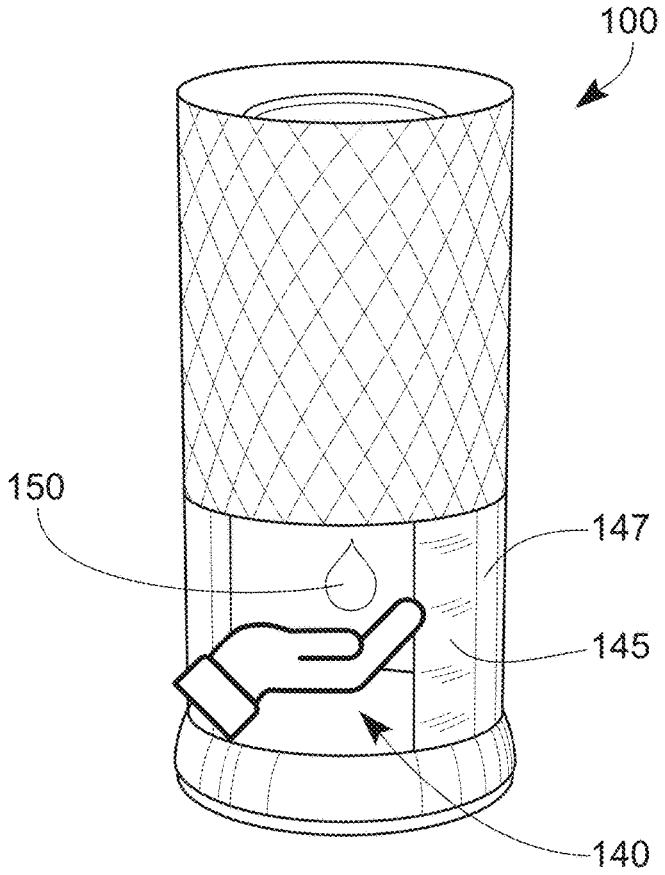

FIGS. 1A and 1B illustrate an example of a dispensing device 100 for use in the present system. The dispensing device 100 includes an outer body 110, a top portion 120, a base 130, and a dispensing portion 140 arranged to provide suitable portability and/or enable convenient placement in an area where a user typically applies skin care compositions (e.g., bathroom sink, bedroom dresser, or dressing room counter). The outer body 110 is configured to provide an aesthetically pleasing exterior facing surface and house the interior components. The top portion 120 may be configured to provide access to the interior of the dispensing device 100, for example, to replace the cartridge(s) containing the skin care active composition(s). As illustrated in FIGS. 1A and 1B, the top portion 120 of the container 100 is concave. However, the top portion 120 may be configured in any suitable shape (e.g., flat or convex), as desired. The base 130 is disposed generally at the bottom of the dispensing device 100 and is configured to stably support the dispensing device 100 during use. The dispensing portion 140 of the dispensing device 100 is disposed between the body 110 and base 130 and includes a nozzle or other suitable component for dispensing the personalized skin care composition 150.

The dispensing portion 140 of the device 100 may be provided as an enclosed or semi-enclosed space between the body 100 and base 120. In some instances, the dispensing portion 140 includes a wall 142 that isolates and/or conceals the dispensing portion 140. The wall 142 may include a movable portion 145 and a stationary portion 147. The wall 142, movable portion 145, and/or stationary portion may be opaque, translucent, or transparent, as desired. The movable portion 145 of the wall 142 may be positioned (i.e., opened) to allow access to the dispensing portion 140 of the device 100 and then repositioned (i.e., closed) to partially or fully enclose the dispensing portion 140. In some instances, the movable portion 145 may be configured as a sliding door that can be opened manually or automatically via a switch, button, and/or sensor coupled to a drive motor. For example, the movable portion may be configured to slide open along a track or groove when a user presses a button and/or activates an optical sensor. In some instances, the movable portion 145 may open automatically when the skin care composition 150 is ready to be dispensed, which may also provide a notification to the user that the personalized skin care composition is ready. The moveable portion 145 may be configured to slide past the interior or exterior side of the stationary portion 147. In some instances, the movable portion 145 may be configured to open in a direction perpendicular to the stationary portion 147 (i.e., outwardly or inwardly from the dispensing portion 140), for example, via a hinge, a hydraulic/pneumatic cylinder, an articulating arm, or the like. The stationary portion 147 may be a discrete element or a unitary portion of the body 110. The stationary portion 147 and movable portion 145 may be designed to provide complimentary aesthetics (e.g., appear to be a unitary element as shown in FIG. 1A) or appear to be discrete components of the device 100 as shown in FIG. 1B. FIG. 1A depicts the movable portion 145 in a closed configuration and FIG. 1B depicts the movable portion 145 in an open configuration. The dispensing portion of the device may include a sensor that detects when it is appropriate to dispense the personalized skin care composition. For example, a motion sensor may be used to detect when a user properly positions their hand to receive the composition.

Figure 2A:
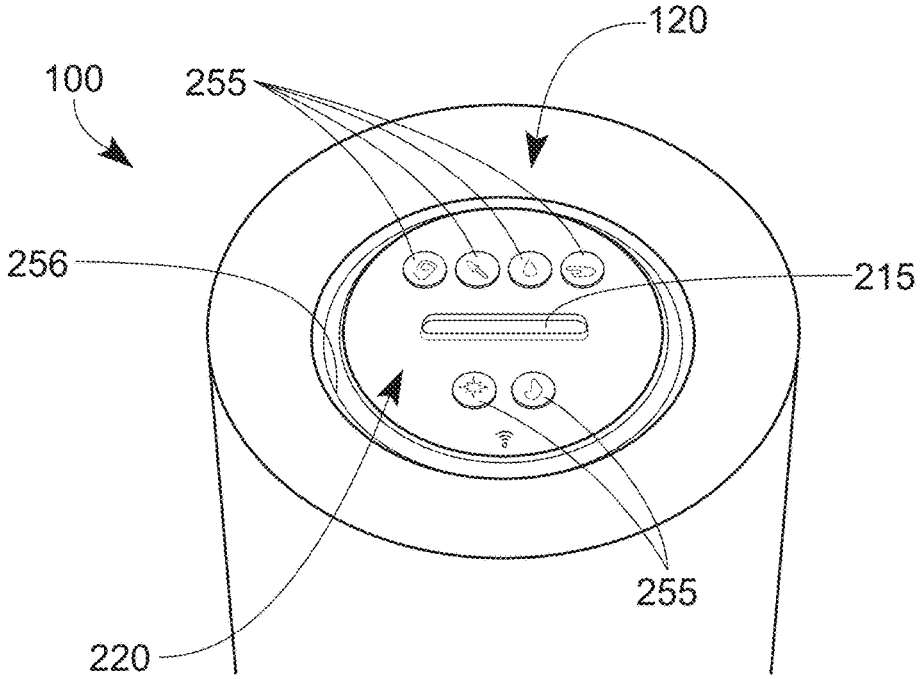
FIGS. 2A and 2B show an embodiment of a dispensing device for use in the present system.
Figure 2B:
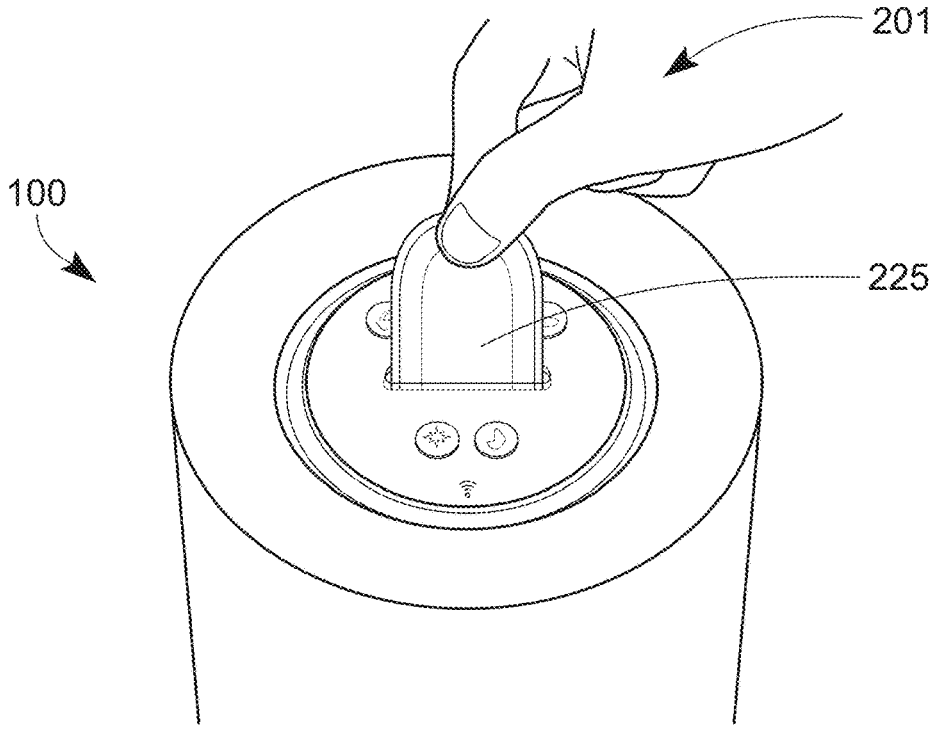

FIGS. 2A and 2B illustrate an example of a top portion 120 of the device 100 from FIGS. 1A and 1B. The top portion 120 includes an openable/closable cover 220 that separates the interior of the dispensing device 100 from the external environment. The cover 220 may include a slot 215 or other opening that enables a user 201 to insert a single-use pod 225 containing the base ingredient(s) into the dispensing device 100. Once inserted into the slot 215, the pod 225 may be positioned within the device 100 using conventional methods known to those skilled in the art. After use, spent pod 225 may be removed by a user manually or automatically. For example, after dispensing the personalized care composition, the dispensing device may eject the spent pod 225 by reversing the steps used to position the pod 225 in liquid communication with the skin care active cartridges. The spent single-use pod 225 may be disposed of or recycled. Additionally or alternatively, the dispensing device may enable a user to access the spent pod 225, for example, via an opening or movable panel, and remove the spent pod 225 manually.

As illustrated in FIGS. 2A and 2B, the cover 220 of the dispensing device 100 may include interface components that communicate information to a user and/or enable a user 201 to interact with the dispensing device 100. In some instances, the interface components may include one or more indicators 255 that communicate information to a user 201, for example, using icons and/or lights (e.g., light emitting diodes). Some non-limiting examples of such information include power status (on/off), network status, internet connectivity, skin care active level, base ingredient pod status, system status (e.g., which step in the process), type of skin care composition being formulated (e.g., face cream, eye cream, serum, moisturizer, toner, daytime product, or nighttime product). For example, one or more indicators 255 may light up (e.g., in a sequence) to indicate a step in the formulation process. In some instances, the indicators 255 may be configured as buttons or switches, which enable a user to operate the device 100 (e.g., turn the device on/off, select a particular skin care composition, alter a composition formulation, connect to a network, open the cover 220 and/or dispensing portion 140, eject a used base ingredient pod 225, or operate some other feature of the dispensing device 100). In some instances, the top portion 120 (e.g., the cover 220) may include a motion sensor (e.g., optical or acoustic) that activates one or more features of the device 100 when motion is detected (e.g., when a user moves their hand within 30 cm of the top of the device 100). In some instances, the top portion 120 may include a light 256 that encircles the top portion 120 to further communicate information to a user 201 or to provide a desirable aesthetic feature. For example, the light 256 may come on when motion is detected and/or when a composition is dispensed. In some instances, the light 256 may be provided in more than one color. For example, a first color (e.g., red) may be used to signal that the device has detected motion or has been powered on, and a second color may be used to signal when a composition is being mixed (yellow) or is ready to be dispensed (green). In some instances, the interface may include a display screen and/or speaker to communicate verbal information to a user visually and/or audibly.

Figure 3:
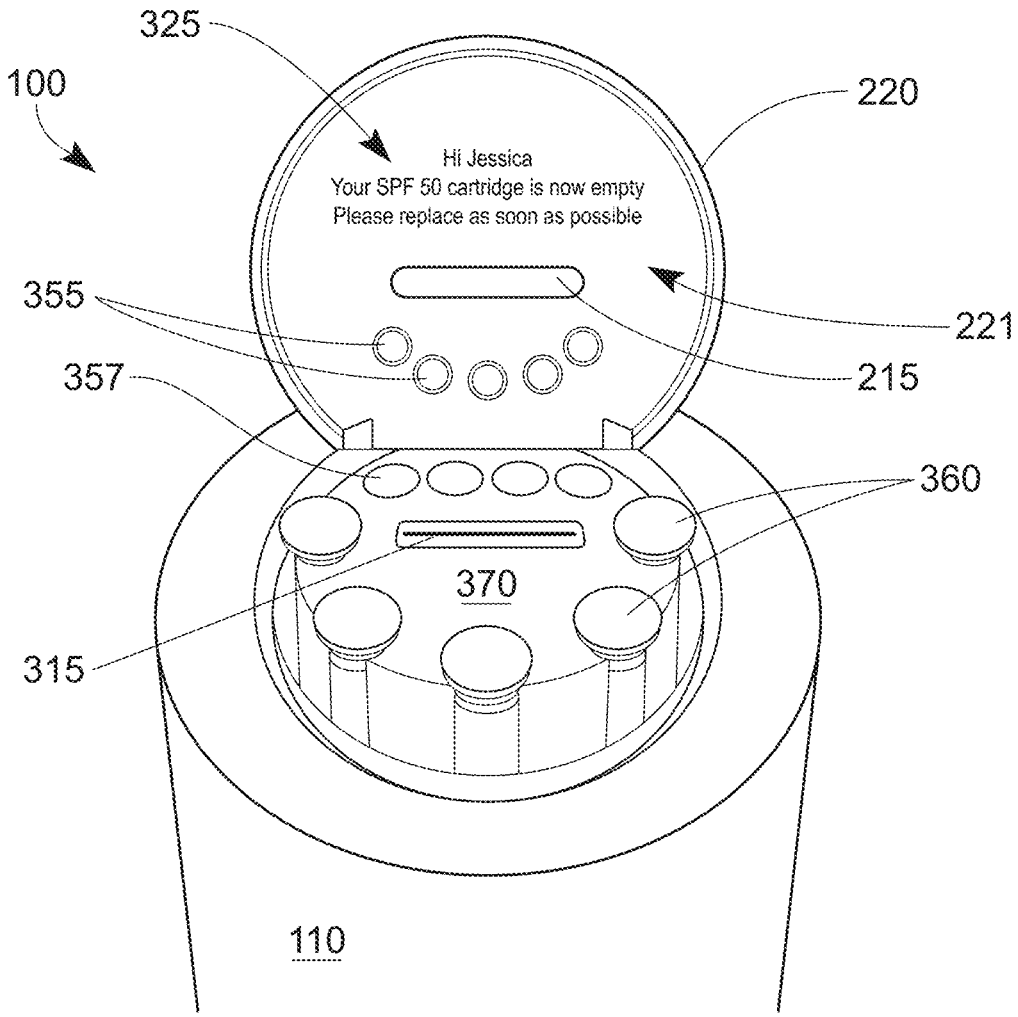
FIG. 3 shows an embodiment of a dispensing device for use in the present system.

FIG. 3 illustrates an example of a top portion 120 of the device 100 from FIGS. 2A and 2B with the cover 220 open. As shown in FIG. 3, the cover 220 can opened to provide access to the interior of the dispensing device 100 and/or cartridges 360. The slot 215 or other opening in the cover 220 is configured to overlay a corresponding slot 315 or other matching opening in the cartridge assembly 370 when the cover 220 is closed. The interior surface 221 of the cover 220 may include indicia 325 and/or indicators 355. The indicia 325 may include instructions or other information related to the use of the device 100, such as, for example, how and/or when to replace the cartridges 360. The indicators 355 may include icons, lights, combinations of these and the like. In some instances, the indicators 355 may provide information to a user related to the amount and/or type of skin care active in each cartridge. For example, an indicator 355 may light up when the level of skin care active in a corresponding cartridge 360 is low and/or the cartridge 360 is empty. As shown in the example in FIG. 3, the number of indicators 355 may be the same as the number of cartridges 360 (i.e., 5). However, it is to be appreciated that the dispensing device 100 may be configured to include any number of indicators 355 and/or cartridges 360.

As illustrated in FIG. 3, the cartridges are disposed in cartridge assembly 370. The cartridge assembly 370 may include a variety of features that enable insertion, retention, removal and/or replacement of the cartridges 360 (e.g., clips, springs, clasps, plungers, pins, screws, magnets, tabs, slots, handles, protrusions, indentations, cartridge geometry, combinations of these, and the like). In some instances, the cartridge assembly 370 can be repositioned to enable a user to access the cartridges 360. For example, the cartridge assembly 370 may be repositioned toward the top portion 120 of the device 100 after opening the cover 220. Similarly, the cartridge assembly 370 may be moved back down into the body 110 of the device 100 prior to closing the cover 220. In some instances, the cartridge assembly 370 may be partially or completely removed from the dispensing device (e.g., through the open top portion 120 of the dispensing device 100). The cartridge assembly 370 may be repositioned manually or automatically using conventional methods known to those skilled in the art.

Figure 4:
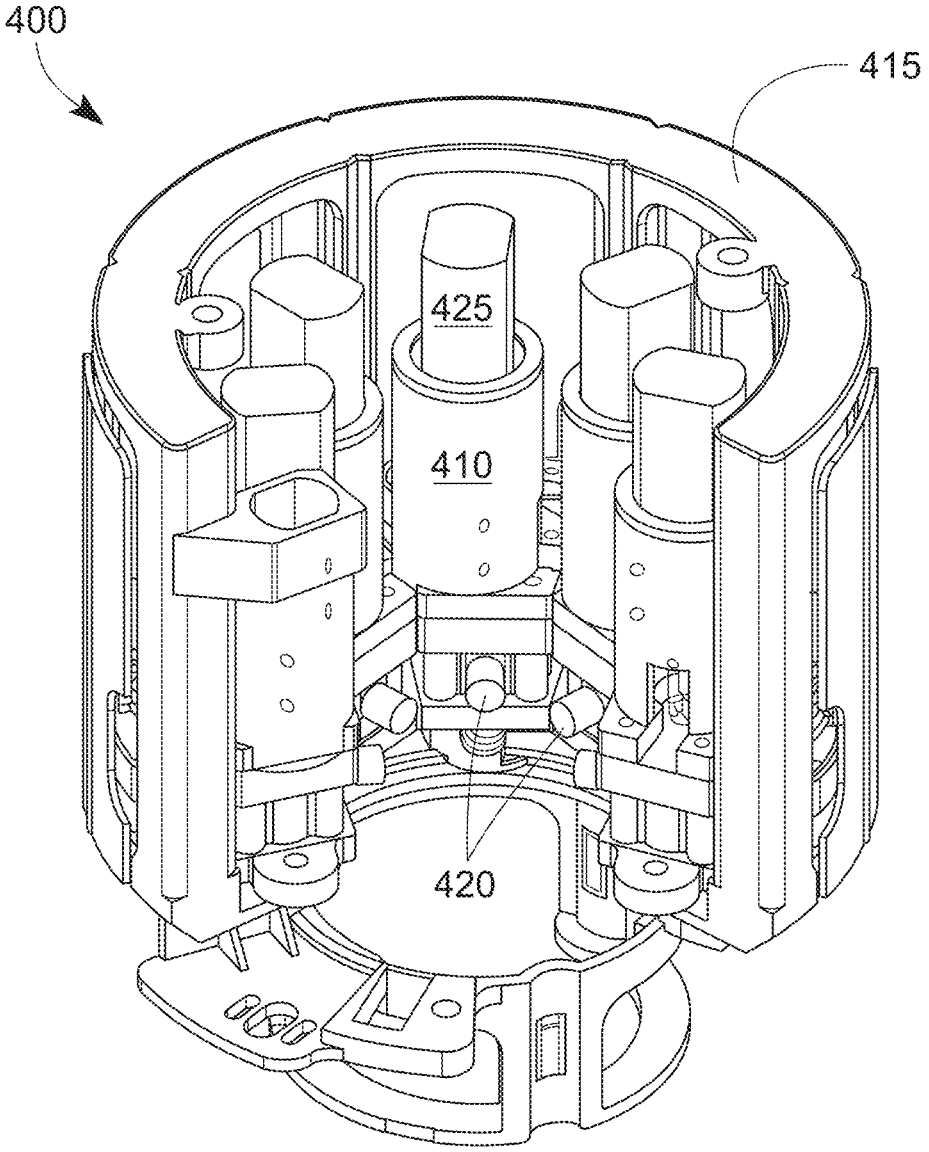
FIG. 4 shows an embodiment of a cartridge carriage.

FIG. 4 illustrates an example of a carriage 400 for use in the cartridge assembly 370. The carriage 400 includes framework 415 that provides a sturdy skeleton to which other components of the carriage 400 and/or cartridge assembly 370 can be joined. The carriage 400 includes one or more cartridge sleeves 410 configured to receive and hold cartridges 360 containing skin care actives. In some instances, a skin care active may be dispensed from a cartridge via a piston 425 coupled to a suitable drive mechanism (not shown). For example, the drive mechanism may include a screw-drive motor coupled to an encoder. In this example, the encoder may be in electronic communication with a programmable controller (e.g., a solid-state microprocessor) that is programmed to control the speed and/or drive time of the motor. Thus, the amount of skin care active dispensed from the cartridge can be precisely controlled. The piston 425 may be an integral component of the cartridge, an integral component of the drive mechanism, or a discrete component. Each cartridge sleeve 410 may include one or more dispensing outlets 420. Each dispensing outlet 420 can be coupled to the single-use pod (not shown) via an aseptic fluid transport system (e.g., sterile tubing and connectors).

Figure 5:
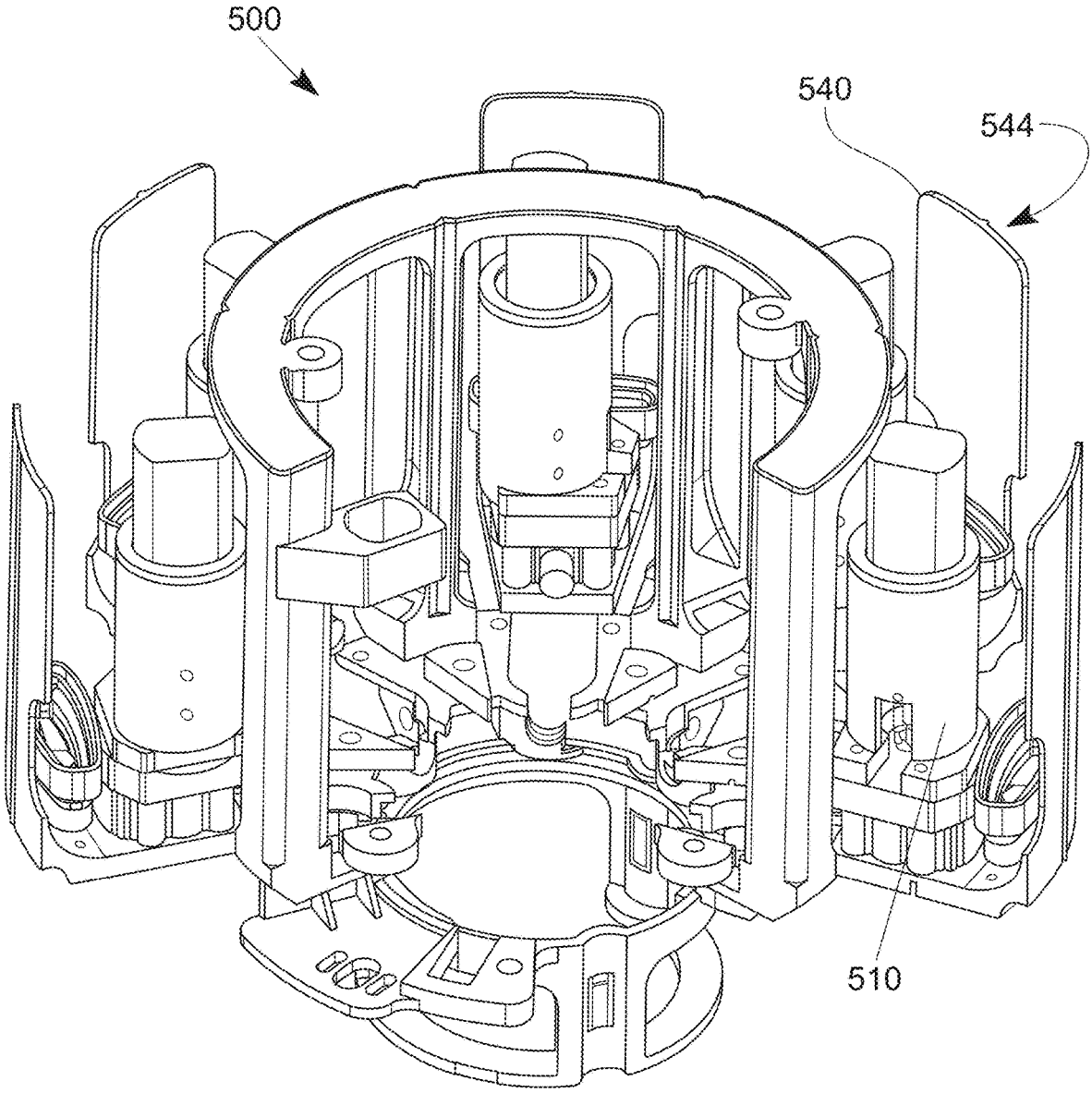
FIG. 5 shows another embodiment of a cartridge carriage.

FIG. 5 illustrates an example of a carriage 500 in which the cartridge sleeves 510 can be horizontally repositioned (i.e., outwardly from the carriage 500) to provide access to the cartridges. In this example, the carriage 500 may be repositioned such that horizontal deployment of the cartridge sleeves 510 is not impeded by the body 110 or other components of the dispensing device 100. Alternatively, the body 110 of the dispensing device 100 may be configured to include one or more openings that enable the cartridge sleeves 510 to deploy horizontally such that the cartridge sleeves 510 extend outwardly from the body 110 of the dispensing device 100. In some instances, the carriage 500 may include one or more panels 540 that have an outer facing side 544 with the same or substantially the same appearance as the outer surface of the body of the dispensing device. In this way, the horizontally deployable cartridge sleeve 510 may be virtually indistinguishable from the body of the dispensing device to provide improved aesthetics.

Figure 6A:
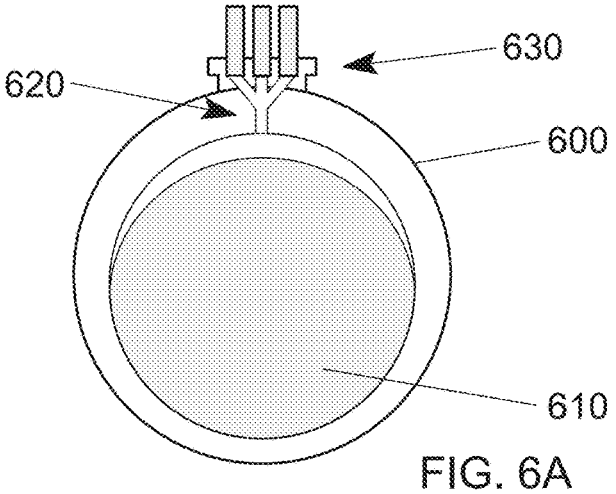
FIGS. 6A, 6B, and 6C show an embodiment of a single-use pod.
Figure 6B:
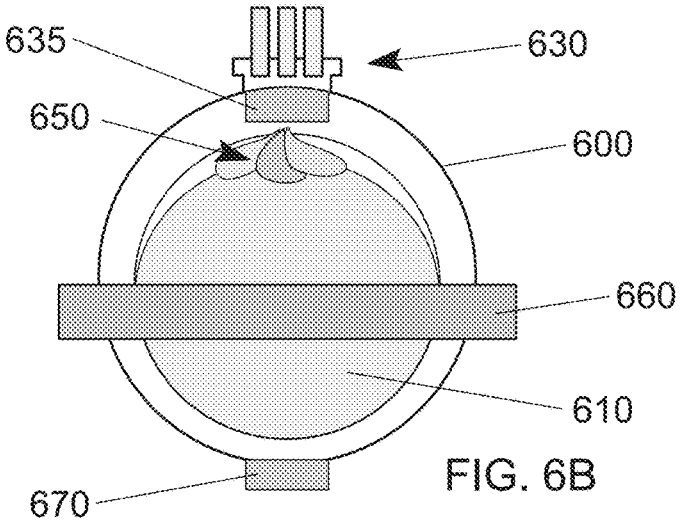
Figure 6C:
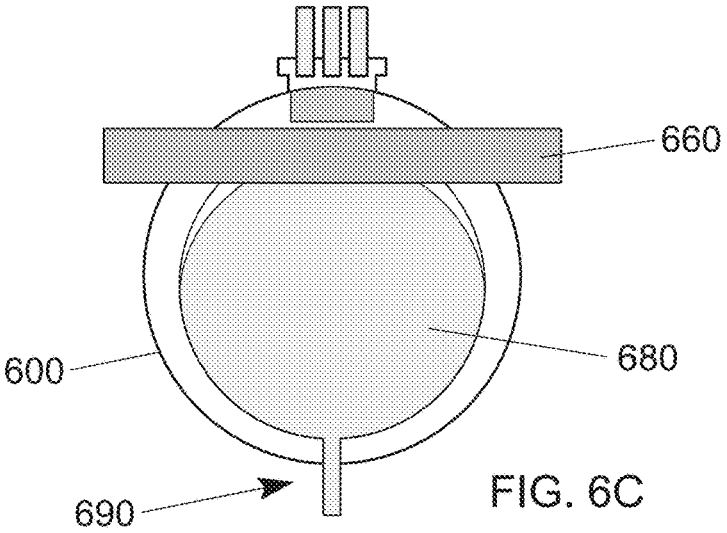

FIGS. 6A, 6B, and 6C illustrate an example of the dosing, mixing, and dispensing portions of the process used by the present system to provide personalized skin compositions. In this example, an aseptic transport system is used to dose the personalized ingredients 650 (e.g., skin care actives into the base composition 610 disposed in the single use pod 600. As illustrated in FIG. 6A, the aseptic transport system may include an insertable element 620 (e.g., rigid tubes, septum needles, combinations of these and the like) that is inserted through an opening 630 at the top of the single-use pod 600. The single-use pod 600 be formed from a liquid-impermeable, flexible material (e.g., a flexible foil material) that provides sufficient strength to withstand each step of the process. In some instances, the flexible material may be made from renewable and/or biodegradable materials (e.g., non-petroleum based). Once the personalized ingredients 650 are dosed into the pod 600, as illustrated in FIG. 6B, the insertable element 620 is removed and the opening 630 is resealed by seal 635, which prevents backflow of the ingredients 610 and 650 out of the pod 600. Some non-limiting examples of suitable seals 635 include check valves, septum stoppers, diaphragms, one-way flow valves, combinations of these, and the like. The personalized ingredients 650 and base ingredients 610 are mixed together by an external mixing element 660. The mixing element 660 applies a mixing force to the outer surface of the pod 600. The mixing force causes the flexible walls of the pod 600 to deform, and thereby provide mixing action to the ingredients 610 and 650 inside the pod 600. In some instances, the mixing element 660 may include a pair of opposable rollers that move along the length of the single-use pod 600 while applying pressure to the flexible walls of the pod 600. Once the ingredients are suitably mixed, the frangible seal 670 at the bottom of the pod 600 is broken to release (dispense) the personalized care composition. In some instances, the mixing element 660 may be configured to apply a dispensing pressure that is sufficient to break the frangible seal 670. In the example illustrated in FIG. 6C, the mixing element 660 may be moved from the top of the pod 600 to the bottom while applying the dispensing pressure, and thereby dispense the personalized skin care composition 680 out of opening 690. In some instances, the system may include a separate dispensing element to dispense the personalized care composition 680.

Figure 7:
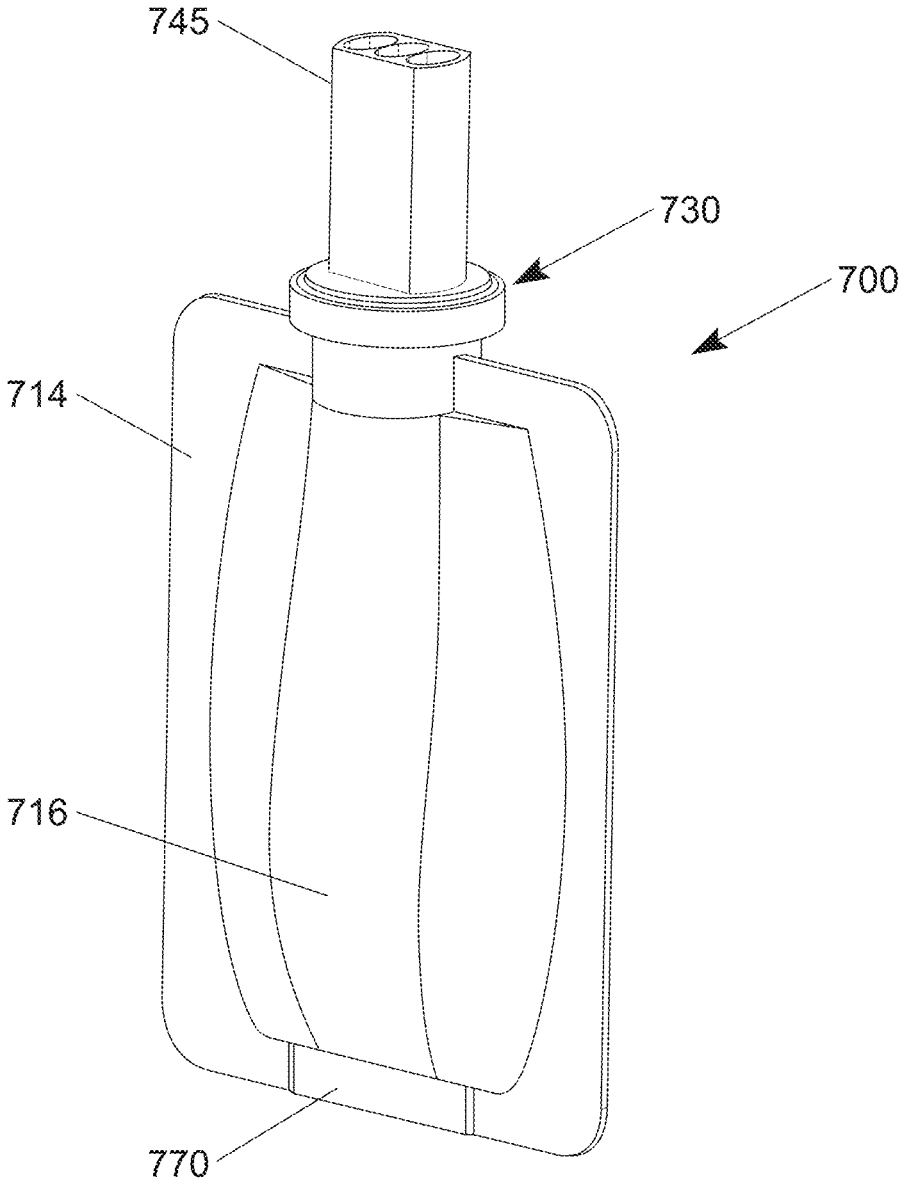
FIG. 7 shows an embodiment of a single-use pod joined to a fluid transport fitting.

FIG. 7 illustrates an example of a single-use pod 700 for use in the present system. In some instances, the single-use pod 700 may include a rigid outer portion 714 that encircles or partially encircles a more flexible inner portion 716. The rigid outer portion 714 may be configured to provide structural stability to the pod 700. In some instances, the rigid outer portion 714 may be substantially inflexible (i.e., does not flex without breaking or exhibiting plastic deformation), or the flexible outer portion 714 may exhibit some amount of flexibility, but not be as much as the flexible inner portion 716. Of course, it is to be appreciated that the pod 700 may have substantially uniform flexibility, as desired. The single-use pod 700 may include a fitting 745 joined to the opening 730 at the top or bottom of the pod 700. The fitting 745 may be rigid or flexible and is configured to cooperate with the aseptic fluid transport system to carry personalized ingredients (e.g., skin care actives) from the cartridges to the pod 700. In some instances, the fitting 745 may be joined to one or more sterile tubes (not shown) which are in turn joined to one or more cartridges. The fitting 745 may be configured to form a liquid impermeable seal with the opening 730. In some instances, the pod 700 may include a frangible seal 770 that provides a fluid impermeable barrier to cover a dispensing opening (not shown). The frangible seal 770 may be a discrete element or it may be integrated into the rigid outer wall 714. The frangible seal 770 may be disposed at the bottom of the pod 700 as illustrated in FIG. 7, or in any other location as desired.

Figure 8:
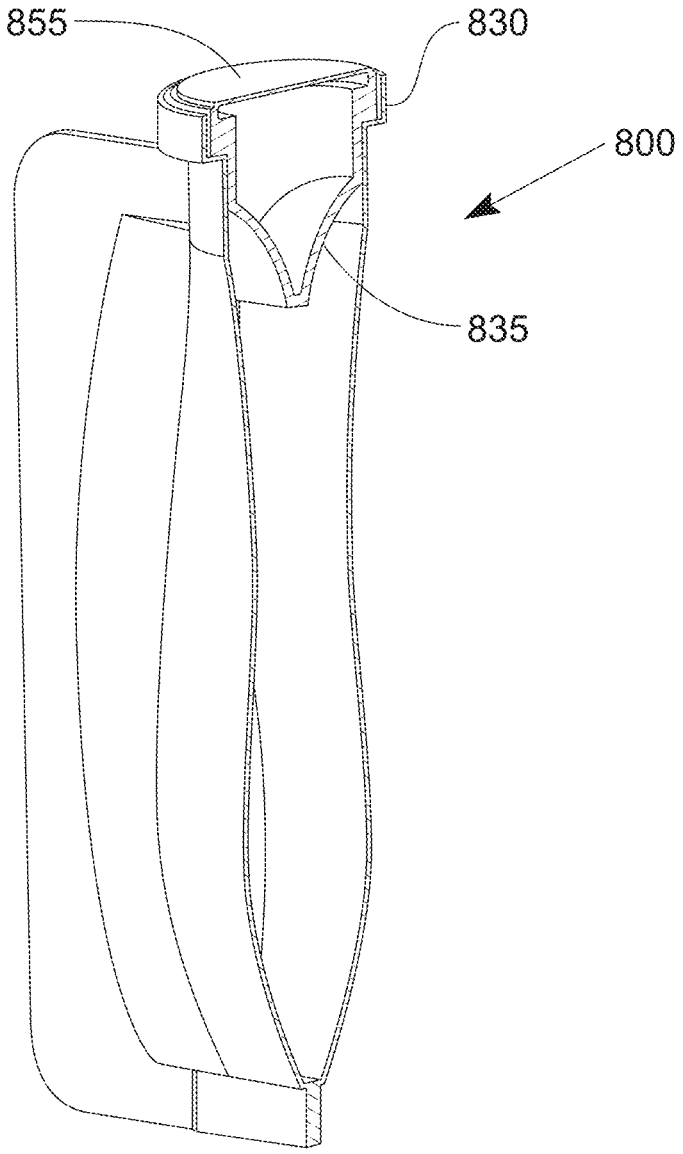
FIG. 8 shows a cut away view of an embodiment of a single use pod.

FIG. 8 illustrates an example of a single-use pod 800 that includes a seal 835 to prevent fluid from flowing out of the pod 800. The seal 835 is configured to mechanically cooperate with the nozzle 830 to form a fluid impermeable barrier, for example, by employing a fluid impermeable diaphragm 855. The seal 835 may be formed from a suitable elastic or plastoelastic material (e.g., rubber, polypropylene, polyethylene, styrenic block copolymers, and the like) that can elastically deform to accommodate the insertion of the insertable element of the aseptic fluid transport system and then reseal the opening 830 once the insertable element is removed.

Figure 9:
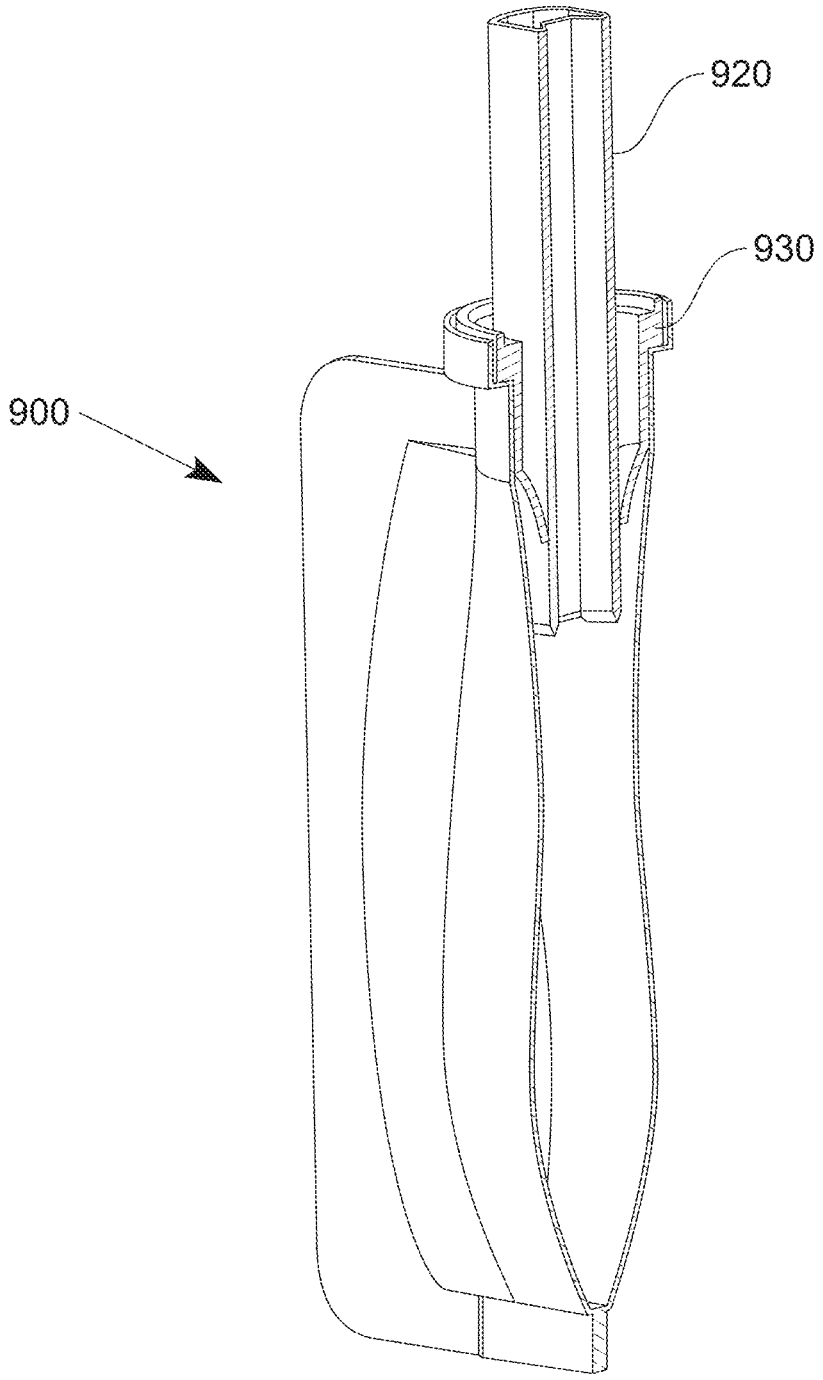
FIG. 9 shows a cut away view of an embodiment of a single use pod with an insertable element inserted through the nozzle of the single-use pod.

FIG. 9 illustrates an example of a single-use pod 900 in which an insertable element 920 associated with the aseptic fluid transport system is inserted through the nozzle 930.

Figure 10:
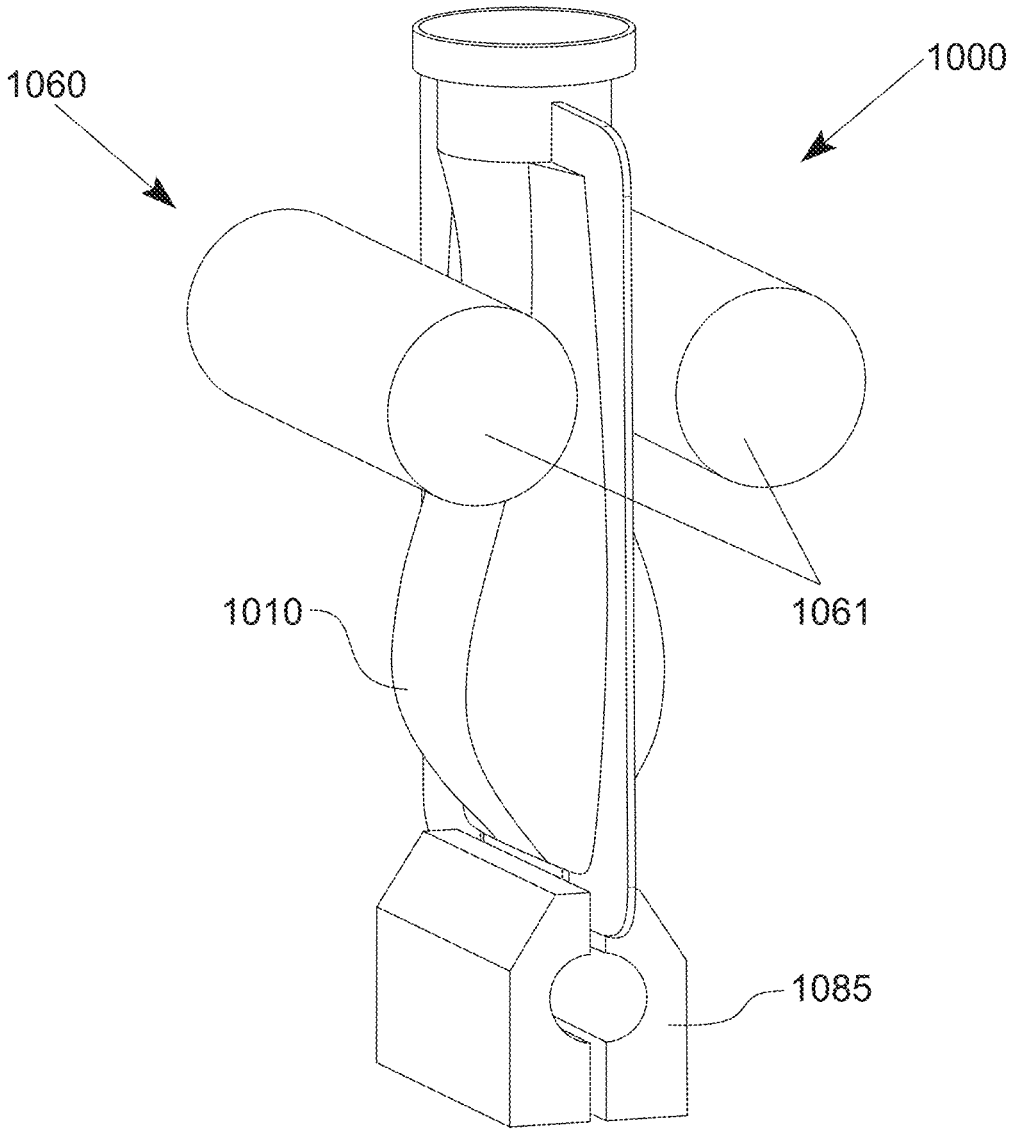
FIG. 10 shows an embodiment of a single-use pod in a mixing configuration.

FIG. 10 illustrates an example of a mixing step. In the mixing step, a mixing element 1060 mixes the ingredients contained in the single-use pod 1000. As illustrated in FIG. 10, the mixing element 1060 that includes a pair of opposing rollers 1061 that apply pressure to the sides of the flexible walls of the pod 1000 while moving up and/or down along the length of the pod 1000. In some instances, the rollers 1061 travel the length of the pod 1000 at least two times (e.g., 3, 4, 5, 6, 7, 8, 9, 10 or more), but typically less than 100 (e.g., less than 90, 80 70, 60, 50, 40, 30, or even less than 20). The speed at which the rollers 1061 travel and the pressure applied may vary depending on the ingredients used in the personalized composition, the properties of the composition (e.g., viscosity), and/or the properties of the pod 1000 (e.g., burst strength of the walls, frangible seal, and/or seal). Of course, it is to be appreciated that other suitable methods of applying pressure to the outside of the flexible walls to mix the ingredients are also contemplated herein. The fluid impermeable seal (not shown) in the opening at the top of the pod 1000 should be configured to prevent the ingredients in the pod from flowing back out of the pod 1000 upon application of the mixing pressure by the mixing element. In this example, a clamp 1085 is provided to help hold the pod 1000 in place and/or to help prevent the frangible seal from breaking prior to the dispensing step.

Figure 11:
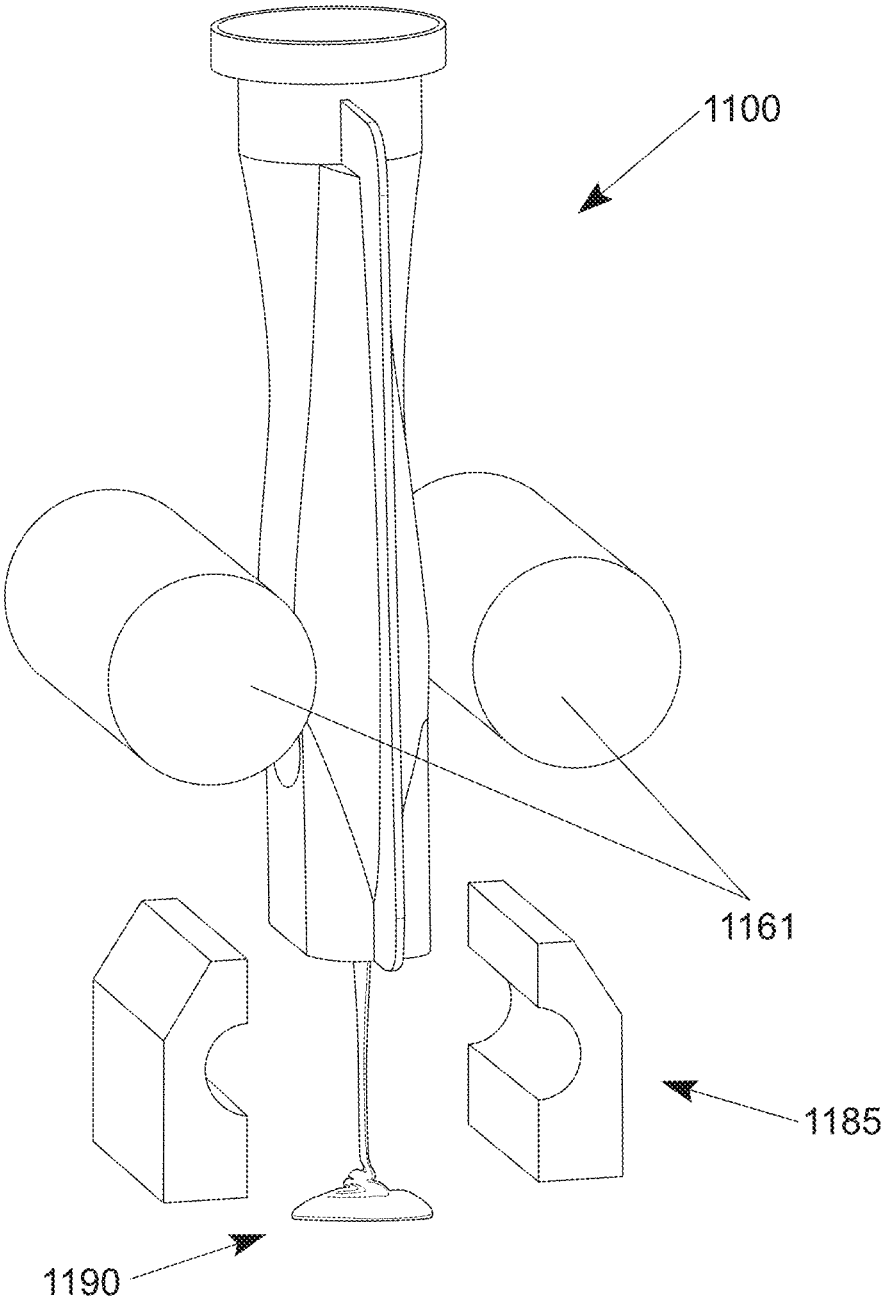
FIG. 11 shows an embodiment of a single use pod in a dispensing configuration.

FIG. 11 illustrates an example of a dispensing step. After the contents of the single-use pod 1100 are mixed, the clamp 1185 is disengaged. Upon application of a suitable dispensing pressure by the mixing element rollers 1161, the frangible seal breaks and the skin care composition 1190 is dispensed. In some instances, the clamp 1185 may be configured to break or weaken the frangible seal. The dispensing pressure may be less than, equal to, or greater than the mixing pressure. The opposing rollers 1161 continue to apply the dispensing pressure to the flexible walls of the pod 1100 while moving down along the length of the pod 1100 to expel as much of the skin care composition as possible from the pod 1100 through an opening (not shown) at the bottom of the pod 1100. The fluid impermeable seal in the nozzle of the pod 1100 should be configured to prevent the ingredients in the pod from flowing back through the nozzle upon application of the dispensing pressure.

Skin Care Composition

The skin care system described herein provides a single-use skin care composition that helps improve the health and/or appearance of skin. The skin care composition is provided in two parts: the base-ingredient(s) contained in a single-use pod, which include a dermatologically acceptable carrier, and the skin care active(s) contained in one or more replaceable cartridges. When multiple cartridges are provided, they may contain the same or different skin care actives at the same or different concentrations. The skin care active(s) are mixed with the base ingredients in the single-use pod to make the final composition, which is then dispensed by the system for topical application to human skin. Some non-limiting examples of forms suited for topical application include solutions, suspensions, lotions, creams, gels, sticks, pencils, sprays, aerosols, ointments, cleansing liquid washes and solid bars, foams, powders, mousses, wipes, strips, patches, wound dressings and adhesive bandages, hydrogels, film-forming products, and facial masks. The cosmetic composition form may follow from the particular dermatologically acceptable carrier chosen.

The skin care compositions herein include one or more skin care actives of the kind commonly included in the particular cosmetic compositing being provided. The skin care actives may be oil-soluble or water-soluble and, when incorporated into the skin care composition, should be suitable for use in contact with human skin tissue without undue toxicity, incompatibility, instability, allergic response, and the like. Some non-limiting examples of classes of skin care actives include, without limitation, vitamins (e.g., vitamin A, vitamin B, and vitamin E compounds and their derivatives), minerals, peptides and peptide derivatives, sugar amines, N-acyl amino acid compounds, sunscreen agents, oil control agents, flavonoid compounds, hair growth regulators, antioxidants and/or anti-oxidant precursors, phytosterols and other plant-derived skin care actives, protease inhibitors, tyrosinase inhibitors, anti-inflammatory agents, emollients, humectants, moisturizing agents, skin tone agents, skin anti-aging agents, exfoliating agents, sunscreen agents, sunless tanning agents, and mixtures thereof. The skin care actives may be included in the final composition at amounts of 0.0001% to 50% (e.g., 0.001% to 20% or even from 0.01% to 10%) by weight of the final composition. Some nonlimiting examples of specific skin care actives which may be suitable for use herein are described in U.S. Pat. No. 9,358,263 to Millikin, et al.

The base ingredients provided in the single-use pod include a dermatologically acceptable carrier (which may be referred to as a "carrier"). The carrier may be present at 50% to 99% (e.g., 60% to 98%, 70% to 98%, or, even 80% to 95%), by weight of the base ingredients and/or the final skin care composition. The carrier may contain one or more dermatologically acceptable, hydrophilic diluents. As used herein, "diluent" includes materials in which a skin care active or other ingredient can be dispersed, dissolved, or otherwise incorporated into the skin care composition. Hydrophilic diluents include water, organic hydrophilic diluents such as lower monovalent alcohols (e.g., C1-C4) and low molecular weight glycols and polyols, including propylene glycol, polyethylene glycol (e.g., Molecular Weight 200-600 g/mole), polypropylene glycol (e.g., Molecular Weight 425-2025 g/mole), glycerol, butylene glycol, 1,2,4-butanetriol, sorbitol esters, 1,2,6-hexanetriol, ethanol, isopropanol, sorbitol esters, butanediol, ether propanol, ethoxylated ethers, propoxylated ethers and combinations of these. The carrier can be in a wide variety of forms. In some instances, the solubility or dispersibility of the components may dictate the form and character of the carrier. Non-limiting examples include simple solutions (e.g., aqueous or anhydrous), dispersions, emulsions, and solid forms (e.g., gels, sticks, flowable solids, or amorphous materials). In a particularly suitable example, the dermatologically acceptable carrier may be in the form of an emulsion. Emulsions are generally classified as two or more immiscible liquids that are mixed together to provide a continuous phase and a dispersed phase. Emulsions herein may have a continuous aqueous phase (e.g., oil-in-water and water-in-oil-in-water) or a continuous oil phase (e.g., water-in-oil or oil-in-water-in-oil).

The base ingredients in the single-use pod and/or the skin care actives in the replaceable cartridges may include other optional ingredients that are conventionally included in skin care composition of the type provided, as long as they are dermatologically acceptable and do not undesirably alter the intended benefit of the skin care composition. The optional ingredients may be present at 0.0001% to 50%, 0.001% to 20%, or even 0.01% to 10%, by weight of the final composition. Some non-limiting examples of optional ingredients that may be suitable for use herein include preservatives, rheology modifiers (e.g., thickeners), pH adjusters, emulsifiers, film-forming agents, skin feel agents (e.g., silicone elastomers), chelators, topical anesthetics, anti-microbial and anti-fungal agents, anti-cellulite agents, anti-oxidants, skin soothing ingredients, sensates, colorants, opacifying agents, particulates, fragrances, essential oils, lubricants, and combinations of these. Further examples of optional ingredients that may be suitable for use in the present skin care compositions are described in U.S. Publication Nos. 2002/0022040; 2003/0049212; 2004/0175347; 2006/0275237; 2007/0196344; 2008/0181956; 2010/00092408; 2008/0206373; 2010/0239510; 2010/0189669; 2011/0262025; 2011/0097286; US2012/0197016; 2012/0128683; 2012/0148515; 2012/0156146; and 2013/0022557; and U.S. Pat. Nos. 5,939,082; 5,872,112; 6,492,326; 6,696,049; 6,524,598; 5,972,359; 6,174,533; and 9,358,263.

Method of Making

The base ingredients and/or skin care actives may be generally prepared according to conventional methods known in the art of making such compositions. For example, the base ingredients may be prepared by mixing the ingredients in one or more steps to a relatively uniform state, with or without heating, cooling, application of vacuum, and the like. Emulsions may be prepared by first mixing the aqueous phase materials separately from the oil phase materials and then combining the two phases as appropriate to yield the desired continuous phase. After mixing, the base ingredients are placed in a suitable package, which is sized to store the desired dose of personalized skin care composition. The package should be able to withstand the forces experienced during manufacturing, shipping, and in situ mixing. In some instances, single-use pod may include a frangible seal that is configured to break upon application of a suitable dispensing pressure. The skin care actives are placed in suitable cartridges that can be removably inserted into the device of the present system. The skin care active cartridges may include one or more aseptic tubes that can be placed in fluid communication with the single-use pod to provide a closed loop system in the dispensing device.

Method of Use

Various methods of treatment, application, regulation, or improvement may utilize the personalized skin care compositions herein. In some instances, the methods can include identifying a target portion of skin (e.g., a facial skin surface such as the forehead, perioral, chin, periorbital, nose, and/or cheek) in need of treatment (e.g., skin that includes visible pigmentation disorders, fine line or wrinkles or other undesirable skin conditions) and/or where treatment is desired, and applying a safe and effective amount of the personalized skin care composition to the target portion of skin. In some instances, the target portion of skin may not exhibit visible signs of a skin condition, but a user (e.g., a relatively young user) may still wish to target such an area of skin if it is one that typically develops skin disorders later in life (e.g., skin surfaces that are typically not covered by clothing, such as facial skin surfaces, hand and arm skin surfaces, foot and leg skin surfaces, and neck and chest skin surfaces). In this way, the present methods and compositions may be used as a preventative measure. The personalized skin care compositions herein may be applied to a target skin portion and, if desired, to the surrounding skin at least once a day, twice a day, or on a more frequent daily basis, during a treatment period. When applied twice daily, the first and second applications may be separated by at least 1 to 12 hours. For example, the skin care composition may be applied in the morning and/or in the evening before bed.

The treatment period is ideally of sufficient time for the personalized skin care composition to improve the health and/or appearance of the target portion of skin (e.g., a reduction in the size of a hyperpigmented spot and/or an improvement in the appearance of fine lines and wrinkles). The treatment period may last for at least 1 week (e.g., about 2 weeks, 4 weeks, 8 weeks, or even 12 weeks). In some instances, the treatment period will extend over multiple months (i.e., 3-12 months) or multiple years. In some instances, a personalized skin care composition may be applied most days of the week (e.g., at least 4, 5 or 6 days a week), at least once a day or even twice a day during a treatment period of at least 2 weeks, 4 weeks, 8 weeks, or 12 weeks.

The personalized skin care compositions herein may be applied locally or generally. In reference to application of the composition, the terms "localized", "local", or "locally" mean that the composition is delivered to the targeted area (e.g., a hyperpigmented spot) while minimizing delivery to skin surfaces where treatment is not desired. The composition may be applied and lightly massaged into an area of skin. The form of the composition or the dermatologically acceptable carrier should be selected to facilitate localized application. While certain embodiments herein contemplate applying a composition locally to an area, it will be appreciated that compositions herein can be applied more generally or broadly to one or more skin surfaces. In certain embodiments, the personalized skin care composition(s) herein may be used as part of a multi-step beauty regimen that involves applying two or more personalized skin care compositions in a sequence.

Figure 12:
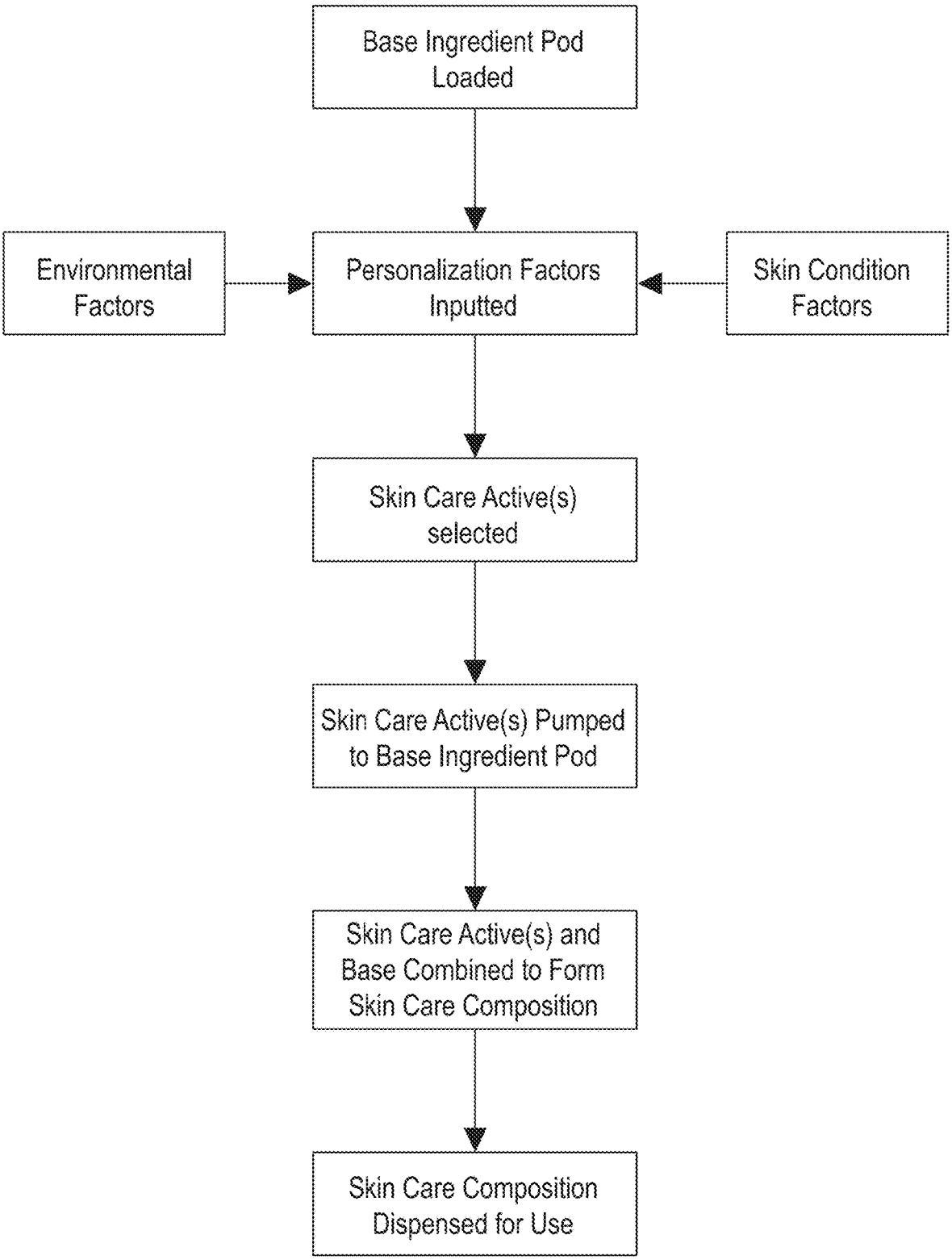
FIG. 12 illustrates steps in a process for using the personalized skin care system.

FIG. 12 illustrates an example of a method of using the personalized skin care system described herein. As illustrated in FIG. 12, the first step in the process is to load the base ingredient pod into the dispensing device. Next, the system access personalization factors, which may be stored on the device (e.g., in a non-transitory memory component) or obtained from remote database or device. The personalized factors can include environmental factors (e.g., geographic location, local weather, UV index) and skin condition factors (e.g., dry, oily, age, ethnicity, time spent outside, skin care history). The personalization factors are used by the system to determine the type and/or amount of skin active to be included in the personalized skin care composition. The appropriate amount of skin care active(s) is transferred to the single-use, base ingredient pod, where the active(s) and base ingredient are mixed together. Once the ingredients are suitably mixed, the personalized skin care composition is dispensed to the user for application to the target portion of skin.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of providing a personalized skin care composition, comprising:

a) inputting a personalization factor into a personalized skin care system, wherein the personalized skin care system comprises:
   (i) a dispensing device that includes at least one wall defining an interior space,
   (ii) a replaceable cartridge disposed in the interior space, the replaceable cartridge containing a skin care active, and
   (iii) a mixing element;
b) placing a single-use pod containing a base ingredient into the interior space of the dispensing device such that the single-use pod is in fluid communication with the replaceable cartridge;
c) selecting a personalized skin care composition formula based on the inputted personalization factor;
d) transferring the skin care active to the single-use pod;
e) mixing the skin care active and the base ingredient with a mixing element to form the personalized skin care composition, wherein the mixing element does not contact the ingredients during mixing; and
f) dispensing the personalized skin care composition.

2. The method of claim 1, wherein the single-use pod comprises a flexible wall portion.

3. The method of claim 2, wherein the single-use pod comprises a rigid wall portion.

4. The method of claim 2, wherein the mixing element mixes the skin care active and the base ingredient together by applying pressure to the flexible wall portion.

5. The method of claim 4, wherein the mixing element comprises a pair of opposing rollers.

6. The method of claim 5, wherein the mixing element moves along the length of the single-use pod while applying pressure to the flexible wall portion.

7. The method of claim 1, wherein the single-use pod further comprises a frangible seal that covers a dispensing opening in the single-use pod.

8. The method of claim 7, wherein the mixing element applies a dispensing pressure that is sufficient to break the frangible seal and dispensing the personal care composition.

9. The method of claim 1, further comprising a clamp that helps hold the single-use pod in place.

10. The method of claim 1, further comprising an indicator that provides a status indication of the personalized skin care system to a user.

11. The method of claim 1, wherein the dispensing device is configured to communicate with a remote computer.

12. The method of claim 1, wherein the single-use pod includes an identifier that can be detected by the dispensing device and causes the dispensing system to provide information to the system.

13. The method of claim 1, wherein the replaceable cartridge contains enough skin care active ingredient to formulate between about 5 and about 60 doses of the personalized skin care composition.

14. The method of claim 1, further comprising an opening that extends from an outer surface of the dispensing device into the interior space, wherein the opening is configured to receive the single-use pod from a user.

15. The method of claim 1, wherein the dispensing device contains between about 2 and about 10 replaceable cartridges, and wherein at least two of the replaceable cartridges contain different skin care actives.

16. The method of claim 1, wherein the dispensing device further comprises a movable wall portion that conceals a dispensing portion of the dispensing device, and wherein the movable wall portion automatically opens to reveal the dispensing portion when the personalized skin care composition is ready to be dispensed.

17. The method of claim 1, wherein the single-use pod is hermetically sealed prior to use.

18. The method of claim 1, wherein the personalization factor is inputted from a skin diagnostic tool.

* * * * *